US011027330B2

(12) United States Patent
Schlichting et al.

(10) Patent No.: US 11,027,330 B2
(45) Date of Patent: Jun. 8, 2021

(54) METHOD OF THIN STRIP CASTING

(71) Applicant: NUCOR CORPORATION, Charlotte, NC (US)

(72) Inventors: Mark Schlichting, Crawfordsville, IN (US); Volus McKenna, Pittsburgh, PA (US); Alan Deno, Greencastle, IN (US); James M. Thomas, Montezuma, IN (US); Philippe Maurice Fettig, Crawfordsville, IN (US); Harold Bradley Rees, Ladoga, IN (US); Nick Corea, Brownsburg, IN (US); Michael Ponder, Danville, IN (US)

(73) Assignee: Nucor Corporation, Charlotte, NC (US)

( * ) Notice: Subject to any disclaimer, the term of this patent is extended or adjusted under 35 U.S.C. 154(b) by 101 days.

(21) Appl. No.: 16/323,976

(22) PCT Filed: Aug. 10, 2017

(86) PCT No.: PCT/US2017/046373
§ 371 (c)(1),
(2) Date: Feb. 7, 2019

(87) PCT Pub. No.: WO2018/031823
PCT Pub. Date: Feb. 15, 2018

(65) Prior Publication Data

US 2019/0210098 A1 Jul. 11, 2019

Related U.S. Application Data

(60) Provisional application No. 62/373,086, filed on Aug. 10, 2016.

(51) Int. Cl.
*B22D 11/06* (2006.01)
*B22D 11/11* (2006.01)
(Continued)

(52) U.S. Cl.
CPC ..... *B22D 11/114* (2013.01); *B22D 11/066* (2013.01); *B22D 11/0622* (2013.01); *B22D 11/1206* (2013.01); *B22D 27/003* (2013.01)

(58) Field of Classification Search
CPC ... B22D 11/06; B22D 11/0622; B22D 11/066; B22D 11/114; B22D 11/1206; B22D 27/003
(Continued)

(56) References Cited

U.S. PATENT DOCUMENTS 4,501,315 A 2/1985 Bercovici
4,678,023 A 7/1987 Knapp et al.
(Continued)

FOREIGN PATENT DOCUMENTS

CA 2268944 C 12/1997
DE 19757704 A1 7/1998
(Continued)

OTHER PUBLICATIONS

EP3496881 Extended European Search Report dated Oct. 2, 2019, 7 pages.
(Continued)

*Primary Examiner* — Kevin P Kerns
(74) *Attorney, Agent, or Firm* — Hahn Loeser & Parks LLP

(57) ABSTRACT

An apparatus for continuous casting a metal strip and reducing snake eggs in the metal strip. A pair of counter rotating casting rolls through which a thin strip can be cast are provided. A metal delivery system is disposed above the nip for discharging molten metal into a casting pool supported on the rolls. A pair of side dam holders and a pair of side dams are assembled adjacent each end portion of the rolls. Each side dam holder is tapered and dovetails with an adjacent side dam to confine the casting pool of molten
(Continued)

metal supported on casting surfaces of the rolls. An oscillation mechanism provides lateral oscillation to each side dam and side dam holder at a frequency 2-50 hertz and with an amplitude 100-2000 μm during casting.

31 Claims, 15 Drawing Sheets

(51) Int. Cl.
*B22D 11/114* (2006.01)
*B22D 11/12* (2006.01)
*B22D 27/00* (2006.01)

(58) Field of Classification Search
USPC ..... 164/463, 480, 428, 416, 478
See application file for complete search history.

(56) References Cited

U.S. PATENT DOCUMENTS

| | | | | |
|---|---|---|---|---|
| 4,694,887 | A | 9/1987 | Matsui et al. | |
| 4,727,927 | A | 3/1988 | Popik | |
| 4,940,077 | A | 7/1990 | Honeycutt, III et al. | |
| 4,986,339 | A | 1/1991 | Miyazawa | |
| 5,060,714 | A | 10/1991 | Yamauchi et al. | |
| 5,188,166 | A | 2/1993 | Perry | |
| 5,191,928 | A | 3/1993 | Sato et al. | |
| 5,221,511 | A | 6/1993 | Fukase et al. | |
| 5,353,861 | A | 10/1994 | Roder et al. | |
| 5,355,935 | A | 10/1994 | Nogues | |
| 5,372,180 | A | 12/1994 | Grocock et al. | |
| 5,390,726 | A | 2/1995 | Fukuda et al. | |
| 5,400,849 | A | 3/1995 | Sasaki et al. | |
| 5,520,243 | A | 5/1996 | Freeman et al. | |
| 5,584,338 | A | 12/1996 | Freeman et al. | |
| 5,704,414 | A * | 1/1998 | Breviere | B22D 11/066 164/428 |
| 5,836,376 | A | 11/1998 | Matsui et al. | |
| 6,202,792 | B1 | 3/2001 | Cheong et al. | |
| 6,585,032 | B2 | 7/2003 | Schwerdffeger et al. | |
| 6,860,317 | B2 | 3/2005 | Kim et al. | |
| 7,100,673 | B2 | 9/2006 | Botham et al. | |
| 7,191,819 | B2 | 3/2007 | Cooper et al. | |
| 7,594,534 | B2 | 9/2009 | Marti et al. | |
| 7,604,039 | B2 | 10/2009 | Nikolovski et al. | |
| 7,650,925 | B2 | 1/2010 | Nikolovski et al. | |
| 7,975,755 | B2 | 7/2011 | Schueren | |
| 8,042,603 | B2 | 10/2011 | Suzuki et al. | |
| 2002/0050335 | A1 | 5/2002 | Kim et al. | |
| 2004/0237283 | A1 | 12/2004 | Branover et al. | |
| 2007/0051487 | A1 | 3/2007 | Marti et al. | |
| 2011/0031644 | A1 | 2/2011 | d'Hone et al. | |
| 2011/0048668 | A1 | 3/2011 | d'Hone | |
| 2011/0108228 | A1 | 5/2011 | Mahapatra et al. | |
| 2012/0235314 | A1 | 9/2012 | Kweon et al. | |
| 2014/0262121 | A1 | 9/2014 | McQuillis | |

FOREIGN PATENT DOCUMENTS

| | | | |
|---|---|---|---|
| EA | 003382 | B1 | 4/2003 |
| EP | 531851 | A1 | 3/1993 |
| EP | 600248 | A1 | 6/1994 |
| EP | 0556657 | B1 | 6/1997 |
| EP | 491641 | B1 | 10/1997 |
| EP | 852165 | A2 | 7/1998 |
| GB | 1154264 | A | 6/1969 |
| JP | S54043160 | A | 4/1979 |
| JP | S55064951 | A | 5/1980 |
| JP | S56165543 | A | 12/1981 |
| JP | S57007027 | B | 2/1982 |
| JP | S57130742 | A | 8/1982 |
| JP | S58029553 | A | 2/1983 |
| JP | S58032551 | A | 2/1983 |
| JP | S58218348 | A | 12/1983 |
| JP | S59153553 | A | 9/1984 |
| JP | S60124451 | A | 7/1985 |
| JP | S60170559 | A | 9/1985 |
| JP | S61027148 | A | 2/1986 |
| JP | S61042454 | A | 2/1986 |
| JP | S61042455 | A | 2/1986 |
| JP | S61140351 | A | 6/1986 |
| JP | S61296943 | A | 12/1986 |
| JP | S62013245 | A | 1/1987 |
| JP | S62259642 | A | 11/1987 |
| JP | S62259644 | A | 11/1987 |
| JP | S62270252 | A | 11/1987 |
| JP | S63180348 | A | 7/1988 |
| JP | H01266946 | A | 10/1989 |
| JP | H01306049 | A | 12/1989 |
| JP | H02025248 | A | 1/1990 |
| JP | H02041742 | A | 2/1990 |
| JP | H02155543 | A | 6/1990 |
| JP | H0360849 | A | 3/1991 |
| JP | H03020296 | B | 3/1991 |
| JP | H04011288 | B | 2/1992 |
| JP | H05004171 | B | 1/1993 |
| JP | H05062017 | B | 9/1993 |
| JP | H05062021 | B | 9/1993 |
| JP | H10040148 | A | 2/1998 |
| JP | H11057746 | A | 3/1999 |
| RU | 2119843 | C1 | 10/1998 |
| WO | 9013376 | A1 | 11/1990 |
| WO | 9601707 | A1 | 1/1996 |
| WO | 9601708 | A1 | 1/1996 |
| WO | 0240200 | A1 | 5/2002 |
| WO | 2010051590 | A1 | 5/2010 |
| WO | 2011081332 | A2 | 7/2011 |

OTHER PUBLICATIONS

PCT/US2017/046373 International Preliminary Report on Patentability dated Feb. 19, 2019, 9 pages.
PCT/US2017/046373 International Search Report and Written Opinion dated Nov. 6, 2017, 15 pages.

* cited by examiner

METHOD OF THIN STRIP CASTING

CROSS-REFERENCE TO RELATED APPLICATIONS

This application claims priority to, and the benefit of, U.S. provisional patent application No. 62/373,086, filed Aug. 10, 2016 with the US Patent Office, where such application is hereby incorporated by reference.

BACKGROUND AND SUMMARY

This invention relates to making thin strip and more particularly casting of thin strip by a twin roll caster.

It is known to cast metal strip by continuous casting in a twin roll caster. Molten metal is introduced between a pair of counter-rotating horizontal casting rolls, which are internally cooled so that metal shells solidify on the moving roll surfaces and are brought together at the nip between the rolls producing solidified strip product delivered downwardly from the nip between the rolls. The term "nip" is used herein to refer to the general region where the rolls are closest together. The molten metal is delivered from a ladle into a smaller vessel, or tundish, from which the molten metal flows through a metal delivery nozzle positioned above the nip, longitudinally between the casting rolls, and forming a casting pool of molten metal supported on the casting rolls above the nip.

The casting pool of molten metal is supported on the casting surfaces of the casting rolls above the nip. The casting pool of molten metal is typically confined at the ends of the casting rolls by side plates or dams, which are held in sliding engagement adjacent the end portions of the casting rolls. The rate of heat loss from the casting pool is higher near the side dams adjacent the end portions of the casting rolls, with temperature gradients in the molten metal in that area increasing the conductive heat loss from the molten metal. This area is called the "triple point region." This localized heat loss gives rise to "skulls" of solid metal forming in that region, which can grow to considerable size. The skulls can drop through the nip of the casting rolls and form defects in the strip known as "snake eggs." When these skulls drop between the roll nip, they may also cause the two solidifying shells at the casting roll nip to "swallow" additional liquid metal between the shells, and cause the strip to reheat and break disrupting the continuous production of coiled strip.

Snake eggs and skulls may also be detected as visible bright bands across the width of the cast strip, as well as by spikes in the lateral force exerted by skulls on the casting rolls as they pass through the roll nip between the casting rolls. Such resistive forces are exerted against the side dams in addition to the forces from the ferrostatic head of the casting pool. Additionally, skulls resulting in snake eggs in the cast strip passing through the nip between the casting rolls can cause lateral movement of the casting rolls and the side dams.

In the past, an increased flow of molten metal to the triple point regions (i.e. "triple point pouring"), near the side dams, was provided to assist in reducing the temperature gradient in the casting pool in those regions; thus, eliminating snakes eggs in the triple point region. Examples of such equipment and processes are set forth in U.S. Pat. No. 4,694,887 and in U.S. Pat. No. 5,221,511. However, as casting sequence lengths become longer, for example greater than 3 ladles, the side dam segment produced as a result of the casting roll edges wearing into the side dam generates a new source of snake eggs. The narrow clearance formed between this side dam segment and the casting roll surface arc allows period penetration of liquid steel, which solidifies and generates unwanted skulls that drop to produce snake eggs. The triple point pouring has not been effective to reduce the formation of these skulls during casting. Therefore, there remains a need to control the formation of unwanted solidified skulls in the casting pool and formation of snake eggs in the cast strip.

Currently disclosed is an apparatus for continuous casting metal strip reducing snake eggs comprising:

(a) a pair of counter rotating casting rolls, each casting roll less than 800 millimeters in diameter and positioned to form a nip there between through which thin strip can be cast;

(b) a metal delivery system disposed above the nip and capable of discharging molten metal to form a casting pool supported on the casting rolls;

(c) a pair of side dam holders and a pair of side dams assembled adjacent each end portion of the casting rolls, each side dam holder tapered along edge portions to dovetail with edge portions of an adjacent side dam assembled in position, and each side dam adapted to confine the casting pool of molten metal supported on casting surfaces of the casting rolls above the nip; and (d) an oscillation mechanism adapted to cause lateral oscillation of each side dam and side dam holder together at a frequency between 2 and 50 hertz and with an amplitude between 100 μm and 2000 μm during a casting campaign.

The oscillation mechanism may be adapted to cause lateral oscillation of each side dam and side dam holder together at a frequency between 2 and 30 hertz and with an amplitude between 100 μm and 2000 μm, preferably between 100 μm and 1250 μm, during the casting campaign. In certain instances, for example, the oscillating mechanism is a motor operating in cooperation with an eccentric. This eccentric may form a cam or an oblong/elongated member, for example, operably attached to a rotational shaft or the like. In other examples, the eccentric forms an annular member attached to a rotational shaft or the like non-centrally, that is, where the annular center is not aligned with the center of the rotational shaft. In either scenario, the eccentric may be configured to generate lateral-only oscillations or both lateral and vertical oscillations. In other instances, a cylinder, such as a hydraulic cylinder is used to generate lateral oscillations. For example, the cylinder may be arranged to extend and retract in the direction of lateral oscillation. By further example, a linkage or the like may be employed to generate the lateral oscillation when the cylinder is arranged to extend and retract in another direction.

Because traditional pinned mounting of side dams would not sufficiently withstand oscillating movement, a different manner for mounting side dams is desirable. Specifically, a dovetail mount is employed, where edge portions of each side dam holder are tapered to dovetail with the adjacent side dam to hold each adjacent side dam in position while in oscillation mode. In certain exemplary instances, the edge portions of each side dam holder tapered to dovetail with the adjacent side dam may be tapered at or between 3 and 15 degrees, although other angles may be employed. Use of a dovetail design provides a stronger, more durable attachment of the side dam to the side dam holder due to the increased contact area between the side dam and holder. Also, a tighter fit is achieved over traditional mounting methods as the side dam is able to be forced downwardly due to the effects of gravity and the downward force applied by the casting rolls. Because this dovetail design would be difficult to install in a traditionally heated state, in certain instances the side dams are installed into the strip caster in an unheated state at room temperature. Production costs are thereby reduced by virtue of not having to heat the side dam prior to installation, and in certain instances, not having to heat the side dam after installation.

Optionally, the apparatus for continuous casting metal strip may further comprise a mechanism providing vertical movement of each side dam holder and adjacent side dam of at least 100 μm per hour during the casting campaign. Alternatively, the mechanism may provide vertical movement of each side dam holder and adjacent side dam by between 3 and 15 millimeters during the casting campaign. Vertical movement may assist in reducing the formation, severity, and frequency of skulls. Again, the edge portions of each side dam holder tapered to dovetail with the adjacent side dam may be tapered at or between 3 and 15 degrees.

Also disclosed is a method of continuously casting metal strip comprising the steps of:

(a) assembling a pair of counter-rotating casting rolls laterally forming a nip between circumferential casting surfaces of the casting rolls through which metal strip can be cast;

(b) assembling a pair of side holders and a pair of side dams adjacent each end portion of the casting rolls with each side dam holder tapered along edge portions to dovetail with edge portions of adjacent side dam assembled in position, and with each side dam adapted to confine a casting pool of molten metal supported on casting surfaces of the casting rolls above the nip;

(c) assembling a metal delivery system above the casting rolls delivering molten metal to form a casting pool supported on the casting surfaces of the casting rolls above the nip and confined by the side dams at each end portion of casting rolls;

(d) laterally oscillating each side dam holder and adjacent side dam at a frequency between 2 and 50 hertz with an amplitude between 100 μm and 2000 μm during a casting campaign; and (e) counter-rotating the casting rolls such that the casting surfaces of the casting rolls each travel inwardly toward the nip to produce a cast strip downwardly from the nip.

The method of continuously casting metal strip may further comprise laterally oscillating each side dam holder and adjacent side dam at a frequency between 2 and 30 hertz with an amplitude between 100 μm and 2000 μm, preferably between 100 μm and 1250 μm, during the casting campaign. Any oscillating mechanism contemplated herein may be employed.

Optionally, the method of continuously casting metal strip may further comprise vertically moving each side dam holder and adjacent side dam at least 100 μm per hour during a casting campaign. Alternatively, the method of continuously casting metal strip may further comprise vertically moving each side dam holder and adjacent side dam between 3 and 15 millimeters during the casting campaign. Once more, in certain exemplary instances, the edge portions of each side dam holder tapered to dovetail with the adjacent side dam may be tapered at or between 3 and 15 degrees.

The current disclosed invention substantially reduces, if not eliminates, the need for triple point pouring to effectively prevent the formation of snake eggs. Reducing or eliminating the need for triple point pouring reduces the thinning of the cast strip edges by shell washing, which results in an improved strip profile, reduces the amount of edge trim, and hence, decreasing the material lost yearly due to edge trimming. To this end, the method of continuously casting metal strip may further comprise discontinuing triple point pouring of molten metal during part of the casting campaign. Additionally, it has been found that by employing the methods and apparatuses disclosed herein, the temperature of the molten steel supplied for casting may be reduced. By eliminating side dam heating and reducing the temperature of the supplied molten steel, production costs are significantly reduced. In fact, it is estimated that an approximately 7% savings may be observed by employing these methods and apparatuses.

Also disclosed is a side dam holder for continuously casting metal strip comprising a side dam holder with edge portions adapted to dovetail with and support an adjacent side dam by tapers at or between 3 and 15 degrees to hold the adjacent side dam and adapted to move with the side dam holder.

Additionally disclosed is a side dam assembly for continuous casting metal strip comprising:

(a) a pair of side dams adjacent to end portions of a pair of counter-rotating casting rolls, each casting roll with less than 800 millimeters in diameters and positioned to form a nip there between through which thin strip can be cast, with each side dam adapted to confine a casting pool of molten metal supported on casting surfaces of the casting rolls above the nip;

(b) a pair of side dam holders, each side dam holder supporting an adjacent side dam and tapered along edge portions to dovetail with edge portions of the adjacent side dam assembled in position and adapted to move with the adjacent side dam; and (c) an oscillation mechanism adapted to cause lateral oscillation of each side dam and side dam holder together at a frequency between 2 and 50 hertz and with an amplitude between 100 μm and 2000 μm during a casting campaign.

Once again, the oscillation mechanism may be adapted to cause lateral oscillation of each side dam and side dam holder together at a frequency between 2 and 30 hertz and with an amplitude between 100 μm and 2000 μm, preferably between 100 μm and 1250 μm, during a casting campaign. Likewise, the oscillation mechanism may comprise any contemplated herein. In particular instances, the edge portions of each side dam holder tapered to dovetail with the adjacent side dam are tapered at or between 3 and 15 degrees. As noted previously, because this dovetail design would be difficult to install in a traditionally heated state, in certain instances the side dams are installed into the strip caster in an unheated state, that is, installed at room temperature.

Optionally, the side dam assembly may further comprise a mechanism providing vertical movement of each side dam holder and adjacent side dam of at least 100 μm per hour during the casting campaign. Alternatively, the side dam assembly may further comprise a mechanism providing vertical movement of each side dam holder and adjacent side dam of between 3 and 15 millimeters during the casting campaign. Vertical movement may also assist in reducing the formation, severity, and frequency of skulls. Again, the edge portions of each side dam holder tapered to dovetail with the adjacent side dam may be tapered at or between 3 and 15 degrees.

DETAILED DESCRIPTION

Figure 1:
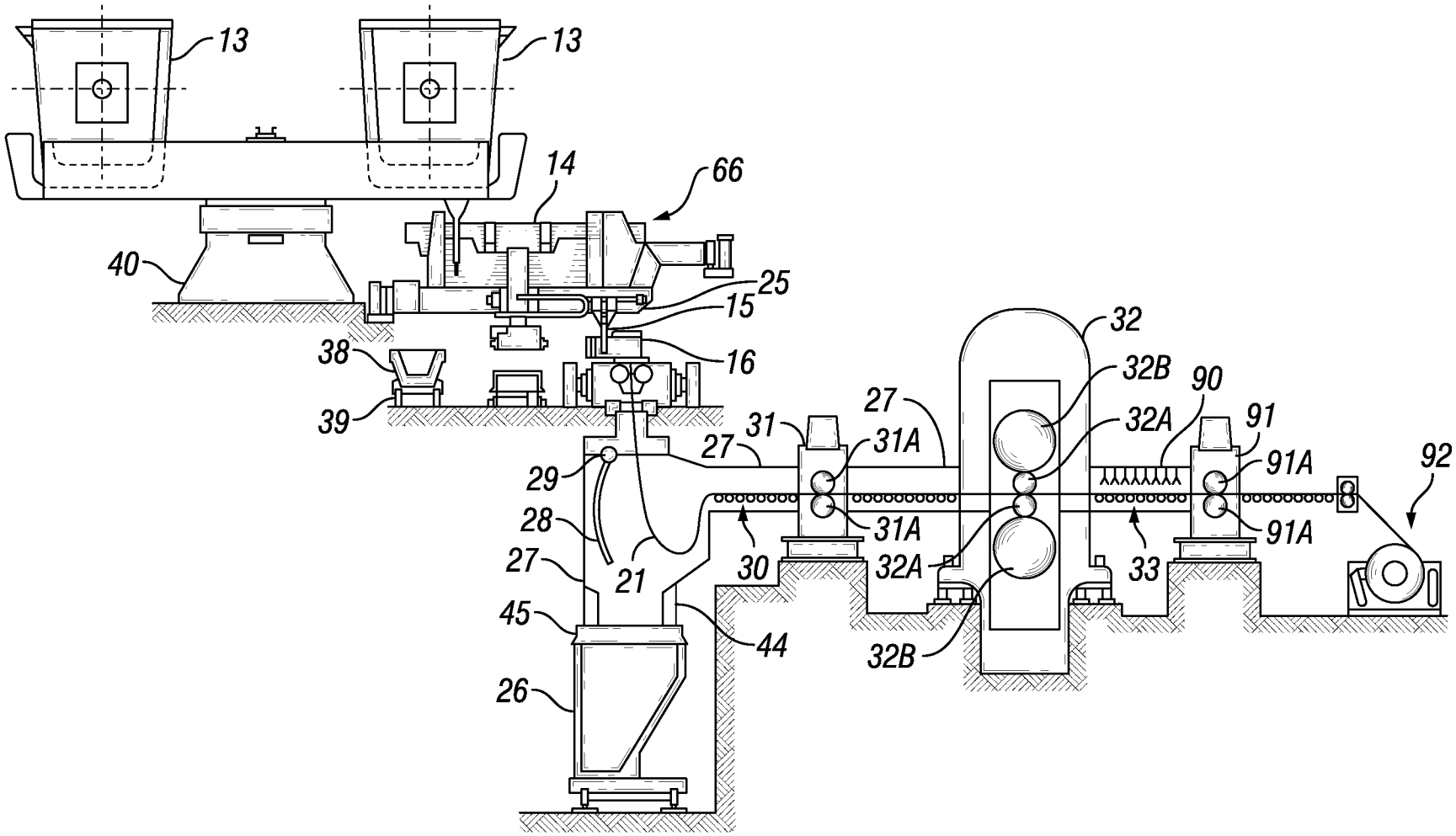
FIG. 1 is a diagrammatical side view of a twin roll caster plant shown operation with the presently disclosed method.
Figure 2:
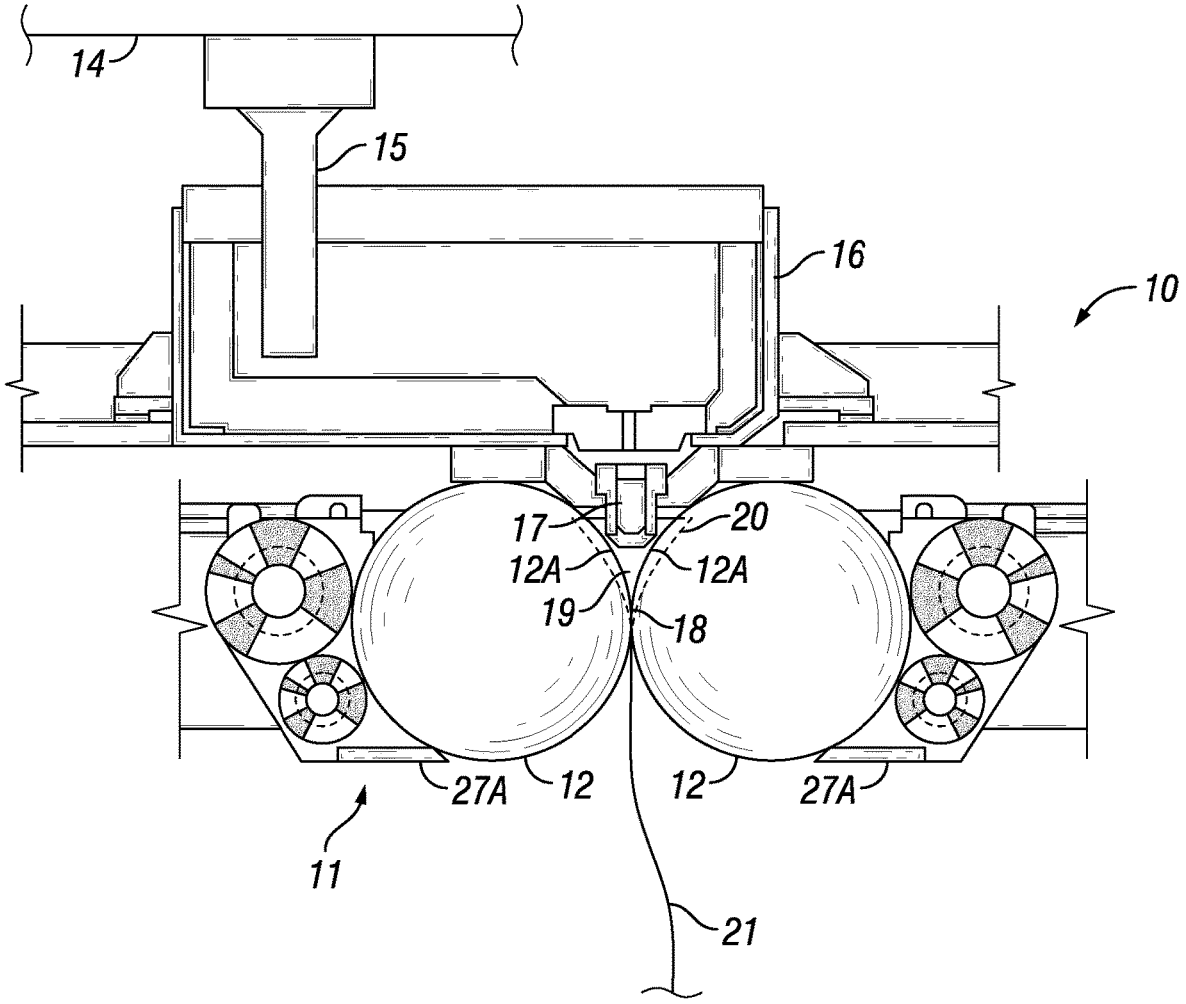
FIG. 2 is a partial sectional view through the casting rolls mounted in a roll cassette in the casting position of the caster of FIG. 1.

Referring now to FIGS. 1 and 2, in one exemplary embodiment, a twin roll caster is shown for continuously casting thin steel strip, which is one of many casters with which the side dam, side dam holder, and oscillating aspects of the side dam may be employed, as any caster employing a side dam may employ the mechanisms and methods described herein. In the embodiment shown, a main machine frame 10 stands up from the factory floor and supports a roll cassette module 11 on which a pair of counter-rotatable casting rolls 12 are mounted. The casting rolls 12 having casting surfaces 12A are laterally positioned to form a nip 18 there between. The roll cassette 11 facilitates rapid movement of the casting rolls 12 as a unit from a setup position, to operative casting position, and rapid removal of the casting rolls from the casting position when the casting rolls are to be replaced. The configuration of the roll cassette may be as desired, so long as it performs that function of facilitating movement and positioning of the casting rolls 12 between the set up position and the operative casting position.

Molten metal is supplied from a ladle 13 through a metal delivery system, such as a movable tundish 14 and a transition piece or distributor 16. From the distributor 16, the molten metal flows to at least one metal delivery nozzle 17, also called core nozzle, positioned between the casting rolls 12 above the nip 18. Molten metal discharged from the delivery nozzle or nozzles 17 forms a casting pool 19 of molten metal supported on the casting surfaces 12A of the casting rolls 12 above the nip 18. This casting pool 19 is confined at the end portions of the casting rolls 12 by a pair of side closures or confining plate side dams 20 (shown in dotted line in FIG. 2). The upper surface of the casting pool 19 (generally referred to as the "meniscus" level) typically rise above the bottom portion of the delivery nozzle 17 so that the lower part of the delivery nozzle 17 is immersed in the casting pool 19. The casting area above the casting pool 19 provides the addition of a protective atmosphere to inhibit oxidation of the molten metal before casting.

The ladle 13 typically is of a conventional construction supported on a rotating turret 40. For metal delivery, the ladle 13 is positioned above a movable tundish 14 in the casting position as shown in FIG. 1 to deliver molten metal to movable tundish 14. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position. An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces 12A rotate into contact with and through the casting pool 19 with each revolution of the casting rolls 12. The shells are brought together at the nip 18 between the casting rolls 12 to produce a solidified thin cast strip product 21 delivered downwardly from the nip 18. The gap between the casting rolls is such as to maintain separation between the solidified shells at the nip so that semi-solid metal is present sandwiched between the shells through the nip, and delivered downwardly as part of the strip below the nip.

FIG. 1 shows the twin roll caster producing the thin strip 21, which passes from the casting rolls across a guide table 30 to a pinch roll stand 31, comprising pinch rolls 31A. Upon exiting the pinch roll stand 31 the thin strip passes through a hot rolling mill 32, comprising a pair of work rolls 32A, and backup rolls 32B capable of hot rolling the strip delivered from the casting rolls. In the hot rolling mill 32, the strip is hot rolled to reduce the strip to a desired thickness, improve the strip surface, and improve the strip flatness. The work rolls 32A have work surfaces relating to the desired strip profile across the work rolls. The hot rolled strip then passes onto a run-out table 33, where it may be cooled by contact with a coolant, such as water, supplied via water jets 90 or other suitable means, and by convection and radiation. In any event, the hot rolled strip may then pass through a second pinch roll stand 91 having rollers 91A to provide tension on the strip, and then to a coiler 92. The thickness of strip may be typically between about 0.3 and 2.0 millimeters in thickness after hot rolling.

At the start of the casting campaign, a short length of imperfect strip is typically produced as casting conditions stabilize. After continuous casting is established, the casting rolls 12 are moved apart slightly and then brought together again to cause the leading end of the thin strip to break away forming a clean head end for the following strip to cast. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the strip 21 onto the guide table 30 and feed the strip 21 through the pinch roll stand 31. The apron 28 is then retracted back to the hanging position to allow the strip 21 to hang in a loop beneath the casting rolls in enclosure 27 before the strip passes to the guide table 30 where it engages a succession of guide rollers.

The sealed enclosure 27 is formed by a number of separate wall sections that fit together with seal connections to form a continuous enclosure that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be completely sealed so as to prevent atmospheric leakage, but rather usually provides a less than perfect seal appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the strip 21.

The enclosure 27 may include an upper collar portion 27A supporting a protective atmosphere immediately beneath the casting rolls in the casting position. When the casting rolls 12 are in the casting position, the upper collar portion is moved to the extended position closing the space between a housing portion adjacent the casting rolls 12, as shown in FIG. 2, and the enclosure 27. The upper collar portion may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

Figure 3:
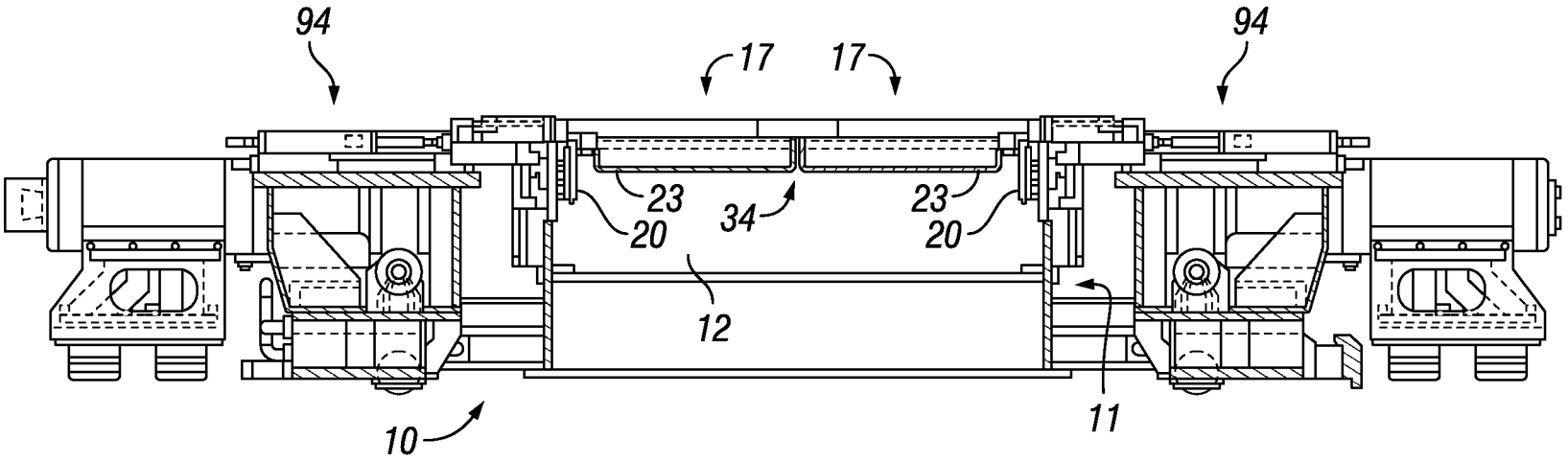
FIG. 3 is a transverse partial sectional view of the twin roll caster shown in FIGS. 1 and 2.

There is shown in FIG. 3 a pair of delivery nozzles 17 each made of a refractory material such as zirconia graphite, alumina graphite or any other suitable material. The two delivery nozzles 17 may be positioned end-to-end as shown in FIG. 3. It must be understood that one or more than two delivery nozzles 17 may be used in any different sizes and shapes if desired. The delivery nozzles 17 need not be substantially the same in size and shape, although generally such is desirable to facilitate fabrication and installation. Two delivery nozzles 17 may be each capable of moving independently of the other above the casting rolls 12.

Typically where two delivery nozzles 17 are used the nozzles 17 are disposed and supported in end-to-end relationship as shown in FIG. 3 along the nip 18 (see FIG. 2) with gap 34 there between, so that each delivery nozzle 17 can be moved inwardly toward the other during a casting campaign as explained below. It must be understood, however, that any desired number of delivery nozzles 17 may be used. Two delivery nozzles may be used as described below, or include any additional number of nozzle disposed there between. For example, there may be a central nozzle segment adjacent to outer nozzle segments on either side.

Each delivery nozzle 17 may be formed in one piece or multiple pieces. As shown, each nozzle 17 includes an end wall 23 positioned nearest a confining side dam 20 as explained below. Each end wall 23 may be configured to achieve a particular desired flow pattern of molten metal flow into the casting pool, particularly in the triple point region between the casting rolls 12 and the respective side dam 20.

The side dams 20 may be made from a refractory material such as zirconia graphite, graphite alumina, boron nitride, boron nitride-zirconia, or other suitable composites. The side dams 20 have a face surface capable of physical contact with the casting rolls and molten metal in the casting pool.

A pair of carriage assemblies, generally indicated at 94, are provided to position both the side dams 20 and the delivery nozzles 17. As illustrated, the twin roll caster is generally symmetrical, although such is not required. Referring to FIG. 3, one carriage assembly 94 is illustrated and described below, with the other carriage assembly being generally similar. Each carriage assembly 94 is disposed at one end of the pair of casting rolls 12. Each carriage assembly 94 may be mounted fixed relative to the machine frame 10, or may be moveable axially toward and away from the casting rolls 12 to enable the spacing between the carriage assembly 94 and the casting rolls 12 to be adjusted. The carriage assemblies 94 may be preset in final position before a casting campaign to suit the width of the casting rolls 12 and strip to be cast, or the position of the carriage assemblies 94 may be adjusted as desired during a casting campaign. The carriage assemblies 94 may be positioned one at each end of the roll assembly and moveable toward and away from one another to enable the spacing between them to be adjusted. The carriage assemblies 94 can be preset before a casting operation according to the width of the casting rolls and to allow quick roll changes for differing strip widths. The carriage assemblies 94 may be positioned so as to extend horizontally above the casting rolls with the nozzles 17 positioned beneath the distributor 16 in the casting position and at a central position to receive the molten metal. For example the carriage assembly 94 may be positioned from tracks (not shown) on the machine frame 10, which may be mounted by clamps or any other suitable mechanism. Alternatively, the carriage assembly 94 may be supported by its own support structure relative to the casting rolls 12.

Figure 4:
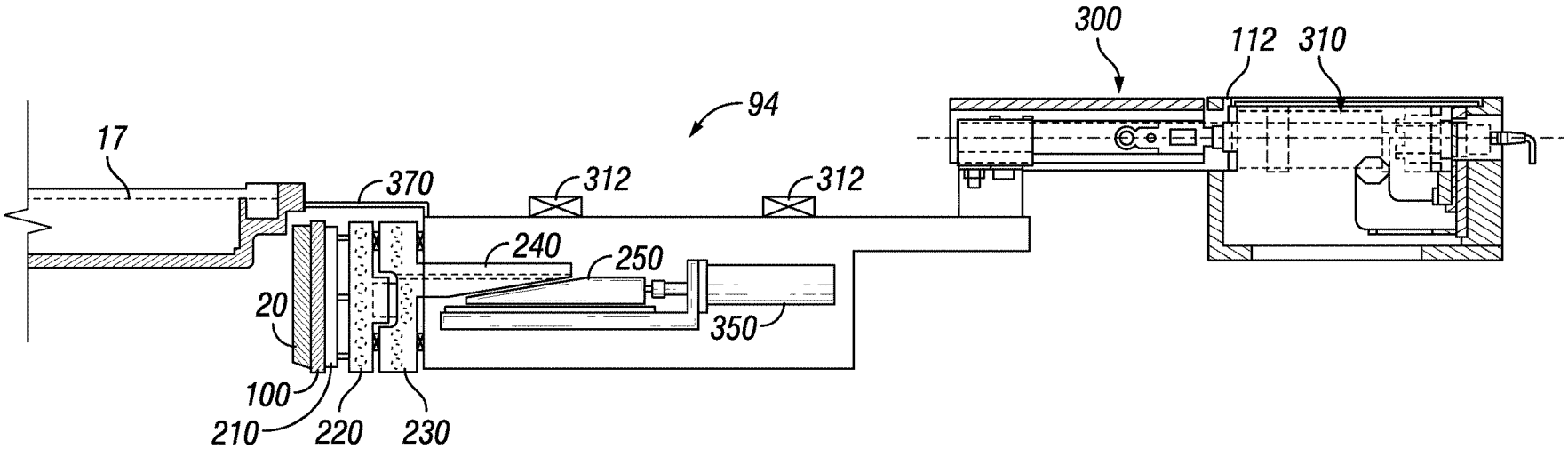
FIG. 4 is a transverse partial sectional view of a side dam unit shown in conjunction with a portion of a twin roll caster, the side dam unit forming one embodiment of the disclosed invention.
Figure 5:
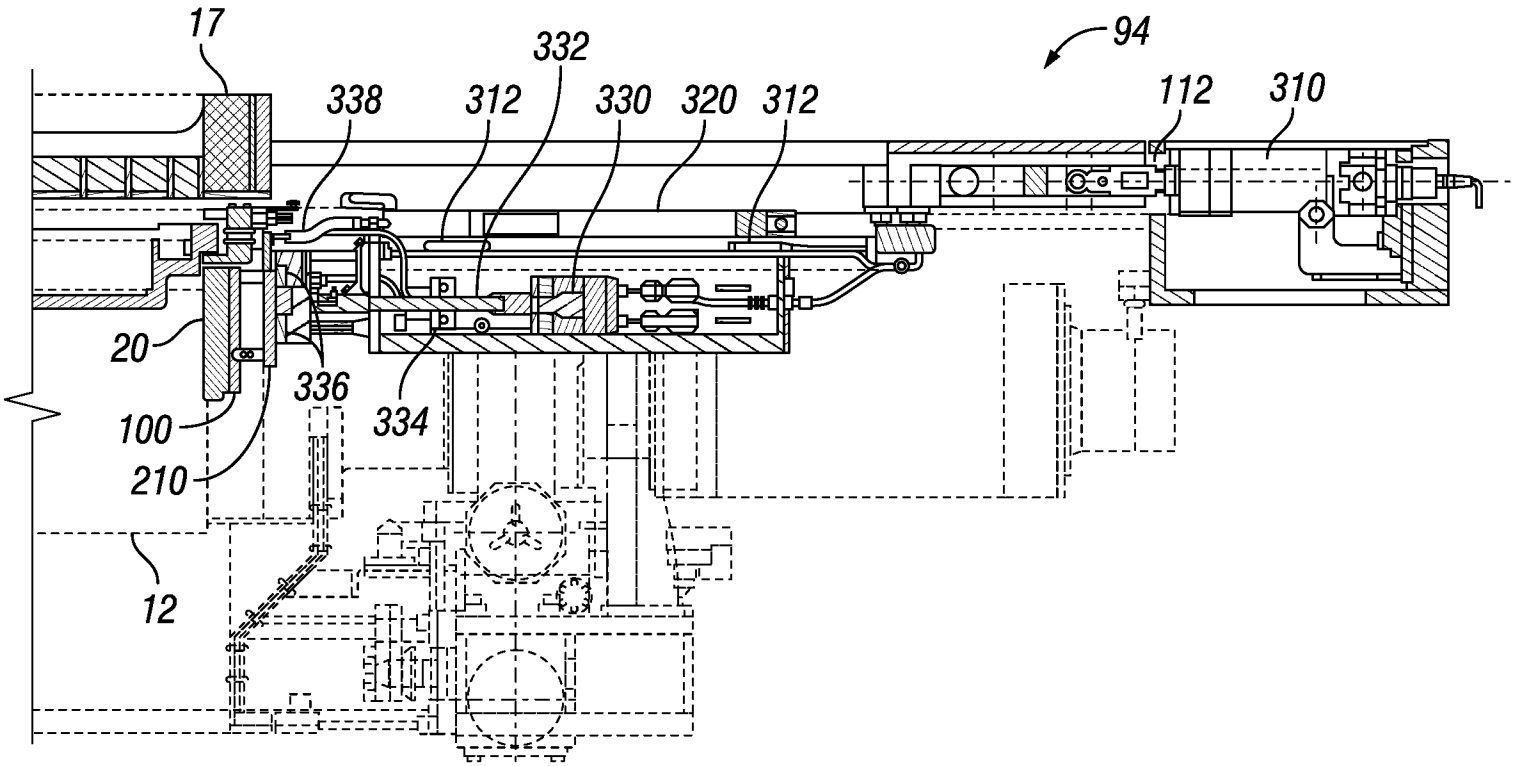
FIG. 5 is a transverse partial sectional view of a side dam unit shown in conjunction with a portion of a twin roll caster, the side dam unit forming another embodiment of the disclosed invention.
Figure 6:
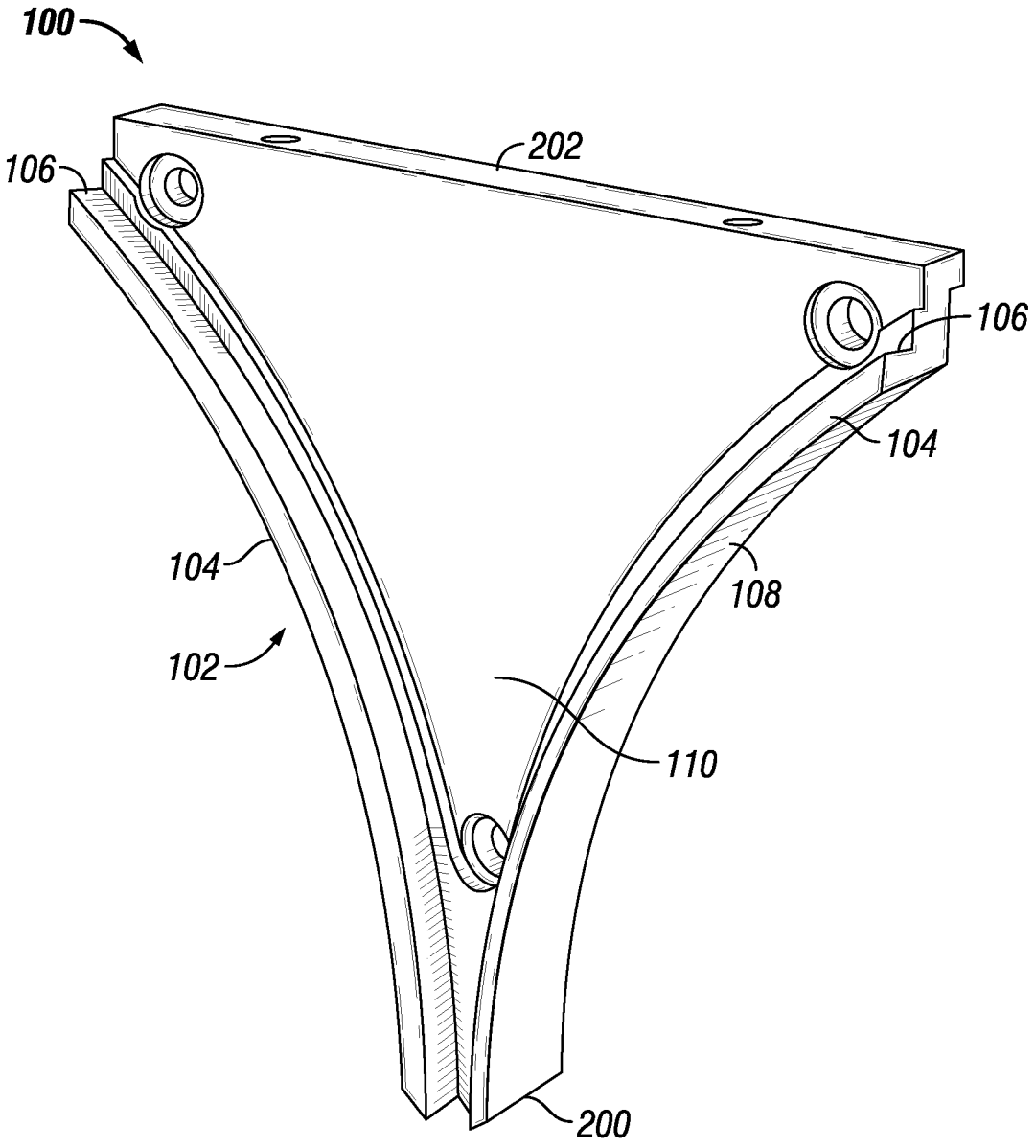
FIG. 6 illustrates in a front perspective view a side dam holder according to one exemplary embodiment of the present invention.
Figure 7:
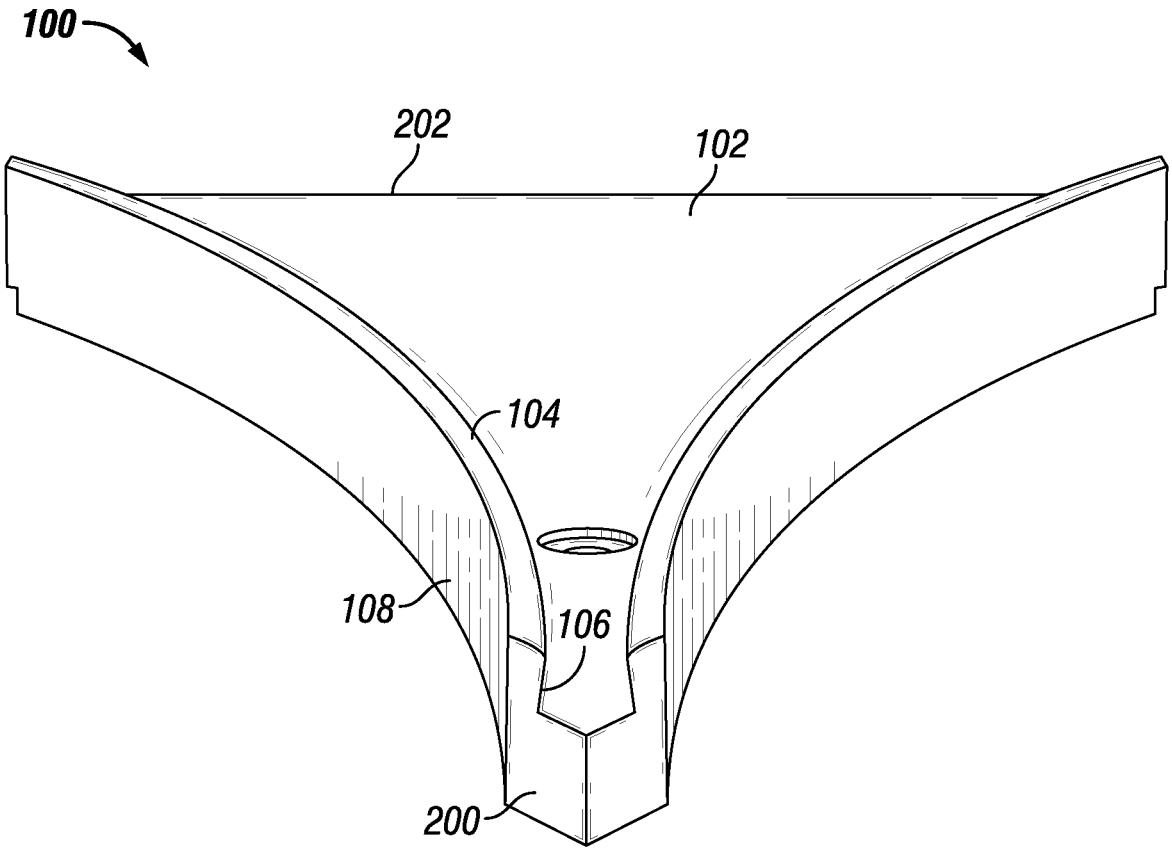
FIG. 7 illustrates in a bottom perspective view a side dam holder of FIG. 6 with tapered edged portions to dovetail with an adjacent side dam.

Referring to one exemplary embodiment in FIG. 4, and to another exemplary embodiment in FIG. 5, each carriage assembly 94 includes a support frame 300, an actuator 310, and a core nozzle support 370. Actuator 310 is moveably connected to the support frame 300 and engages (that is, actuates) both the delivery nozzles 17 and the side dam holder 100 for selective movement of both the delivery nozzles 17 and side dam 20. Actuator 310 is capable of positioning both the delivery nozzles 17 and the side dam 20, and is also capable of cyclically varying the axial force of the side dams.

Actuator 310 is a hydraulic cylinder. It must be understood, however, that actuator 310 may be any suitable drive mechanism suitable to move and adjust delivery nozzles 17 and suitable to position the side dam holder 100 to bring the adjacent side dam 20 into engagement with the casting rolls 12 to confine the casting pool 19 formed on the casting surfaces 12A during a casting operation (see FIG. 2). Such a suitable drive mechanism, for example, may be a servo mechanism, a screw jack drive operated by electric motor, a pneumatic mechanism, a gear mechanisms, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device. Each side dam 20 is mounted with an adjacent side dam holder 100, and movable together with actuator 310, such as a servo mechanism, to bring the side dam 20 into engagement with an end portion of the casting rolls. Linear bearings 312 are employed to slidably connect carriage 94 generally to the nozzle 17, and more specifically, to slidably connect support frame 300 to a core nozzle plate 320, which is directly or indirectly attached to nozzle 17. It is noted that this slidable connection is located above the side dam and above the side dam oscillating components.

A side dam position sensor 112 senses the position of the side dam 20. The side dam position sensor 112 is a linear displacement sensor to measure the actual change in position of the side dam holder 100 relative to the support frame 300. The side dam position sensor 112 may be any sensor suitable to indicate any parameter representative of a position of the side dam 20. For example, the side dam position sensor 112 may be a linear variable displacement transducer to respond to the extension of the actuator 310 to provide signals indicative of position of the side dam 20, or an optical imaging device for tracking the position of the side dam 20 or any other suitable device for determining the location of the side dam 20. The side dam position sensor 112 may also or alternatively include a force sensor, or load cell for determining the force urging the side dam 20 against the casting rolls 12 and providing electrical signals indicative of the force urging the side dam against the casting rolls. Alternatively, a load cell may be placed adjacent oscillation plate 210. In any case, actuator 310 and sensor 112 may be connected into a control system with a circuit receiving control signals determined by the movement of the side dams. During a casting campaign the control system of the twin roll caster is capable of actuating the actuator 310 to vary the apply force on the side dams 20 against the end portions of the casting rolls 12 along the axis of the two casting rolls. The control system may receive position or force information from the sensors 112 or from direct feedback of the actuator 310.

Figure 8A:
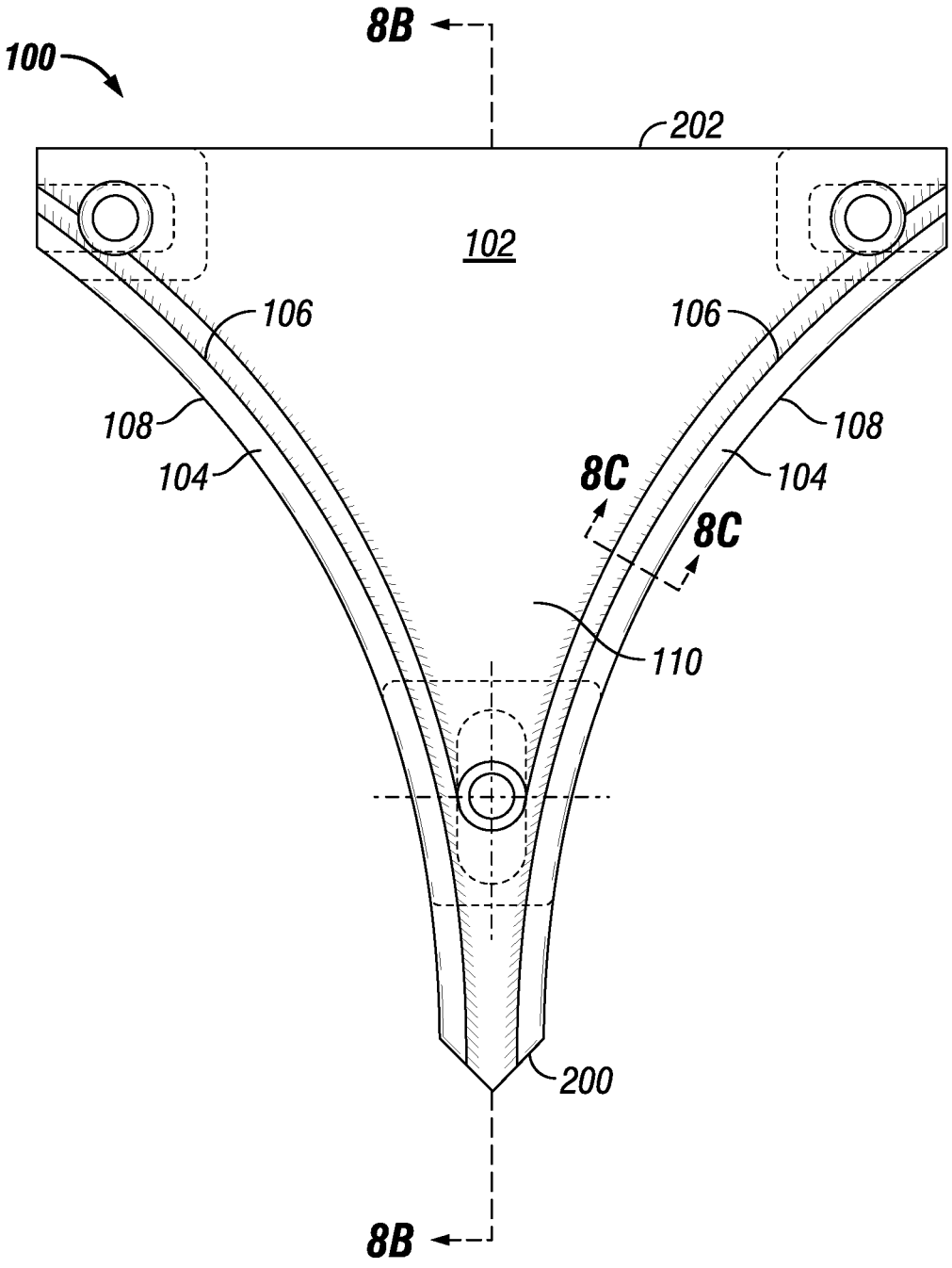
FIG. 8A illustrates a front view of the side dam holder shown in FIG. 6.
Figure 8B:
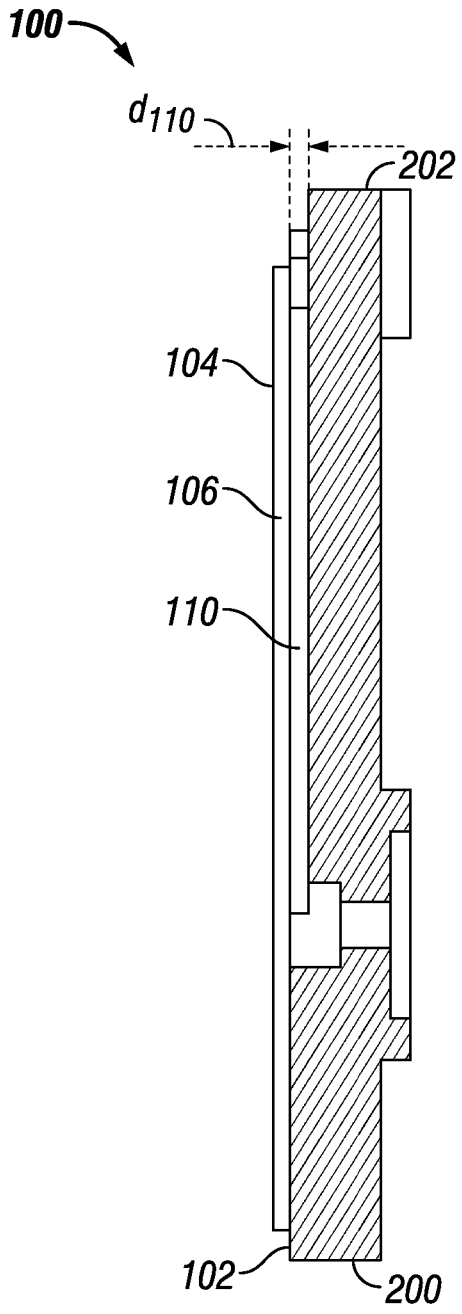
FIG. 8B is a sectional view of the side dam holder in FIG. 8A taken along line 8B-8B.
Figure 8C:
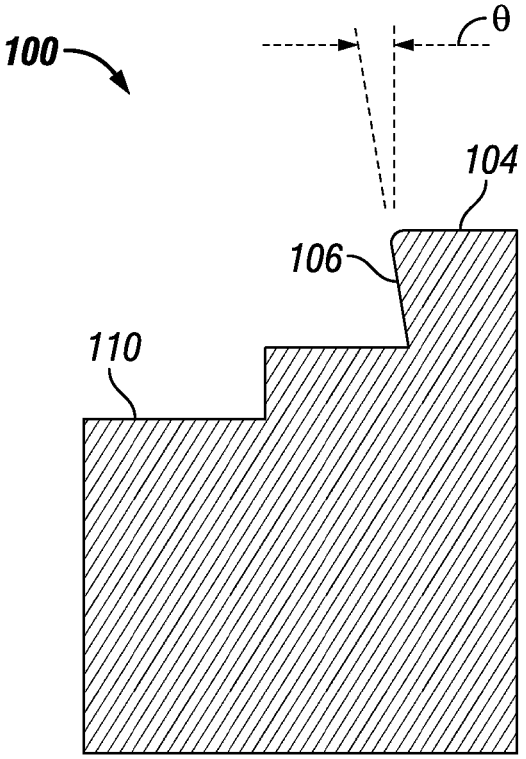
FIG. 8C is a sectional view of the side dam holder in FIG. 8A taken along line 8C-8C.

As explained above and illustrated in FIGS. 6 to 8C, each side dam 20 (shown FIGS. 4, 5, and 9) is mounted within an adjacent a side dam holder 100. Side dam holder 100 has a thickness extending between opposing sides, one side 102 being configured to receive a side dam. The one side 102 includes side dam mounting projection 104, each projection is tapered along a side edge portion 106 to dovetail with the tapered side edge portions of an adjacent side dam to assemble the side dam within the side dam holder and into an installed position. The tapered side edge portions 106 shown form inner side edges of each projection 104, that is, each forms a side edge that faces a lateral center of the side dam holder. Instead, it is appreciated that in other variations the tapered side edge portion for dovetailing with a corresponding tapered side edge on a side dam may instead form an outer side edge 108 of each projection 104. Each projection extends lengthwise at least a partial height and up to the full height of the side dam holder, the height extending from a bottom 200 of the side dam holder to a top 202 of the side dam holder. In the exemplary embodiment shown, each projection 104 extends predominantly the full height of the side dam holder 100. By virtue of using a dovetail attachment between the side dam and the side dam holder, a more durable and tighter fitting attachment is achieved to better hold the adjacent side dam in position while the side dam and side dam holder are laterally oscillated together. With specific reference to FIG. 8C, it is shown that side edge portions 106 of the side dam holder 100 to dovetail with the adjacent side dam may be tapered by angle θ at or between 3 and 15 degrees. The tapered edge portions may be continuous through the contact internal surface of the side dam holder.

Figure 9:
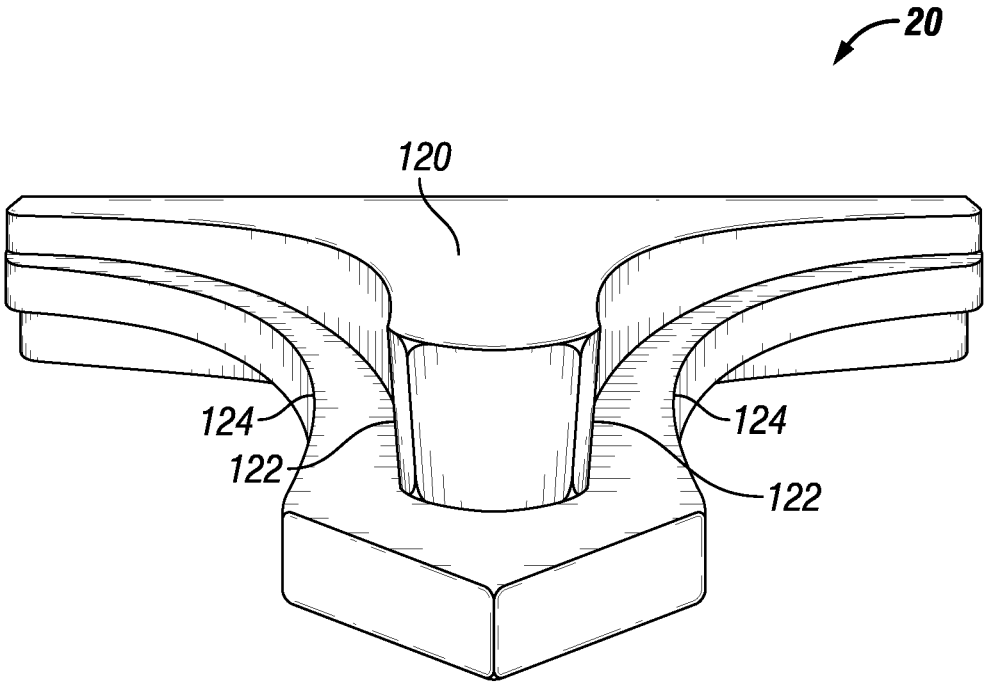
FIG. 9 illustrates a side dam with tapered edge portions to dovetail with an adjacent side dam holder.
Figure 10:
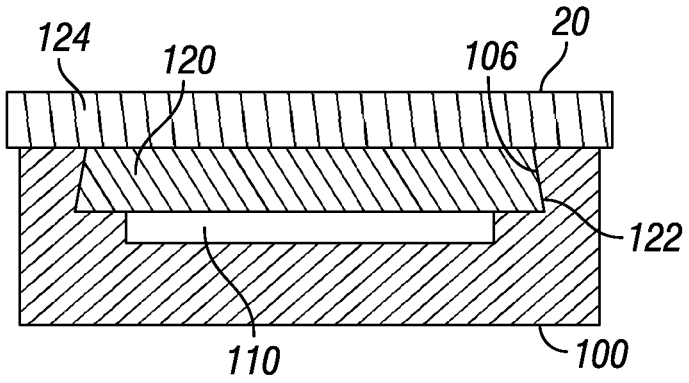
FIG. 10 illustrates a cross-sectional view taken transversally across side dam installed in a side dam holder according to the embodiments described in association with FIGS. 6-9, where a dovetail joint is formed there between, the section being taken centrally across the side dam holder between side edge portions thereof (such as normal to the line 8B-8B in FIG. 8A)

The tapered edge portions on the side dams allow the side dam holder to hold the adjacent side dam in position. An exemplary side dam 20 is shown in FIG. 9 configured to matingly dovetail with the side dam holder shown previously, the side dam 20 having a generally triangular shape similar to the side dam holder, having arcuate lateral sides 124. Side dam 20 also includes a central projection 120 extending outwardly from a back side of the side dam, the back side being arranged opposite a casting roll side of the side dam and of the side dam thickness, the casting roll side including refractory for engaging the casting rolls and forming the casting pool of molten steel. Opposing lateral sides of projection 120 include tapered side edges 122. It is appreciated that even though both tapered side edges 122 are arranged along a single projection 120, multiple projections may be provided where separate tapered side edges 122 are arranged along different projections. It is noted that dovetail joints can accommodate projections of different sizes. Also, each side dam holder may accommodate side dams of different thicknesses. For example, a side dam holder having a dovetail design can accept different side dams each having a thickness of 27, 40, and 44 millimeters (mm) respectively. In either case, the tapered edge portions on the side dam and side dam holder may be continuous or intermittent along the edge portions of the side dam holder and side dam, and need not be conversely identical. It is sufficient for the tapered edge portions on the side dam holder and side dam be such so as to hold the side dam in casting position during the casting campaign. With reference to FIG. 10, side dam 20 is shown mounted onto side dam holder 100 by way of a dovetail joint formed there between.

Optionally, an air gap is arranged between the side dam and the side dam holder. This provides improved insulative properties to protect the side dam holder and to prevent heat loss from the casting pool through the side dam. In the exemplary embodiment shown in FIGS. 6, 8A, 8B, and 10, a recess 110 is arranged within side 102 between opposing projections 104 to provide the air gap. However, other variations may be employed to achieve this air gap. For example, alternatively or additionally, a like recess may be arranged centrally within the backside of the side dam. In certain embodiments, this air gap extends along at least 50% and in other variations 85% to 90% of the area between the side dam and side dam holder. In certain instances, the depth $d_{110}$ of recess 110, as reflected in FIG. 8B, and/or the corresponding air gap is 3 mm to 10 mm, and 5 mm in other certain instances.

In any case, during casting, the side dams move inwardly against the ferrostatic force of the casting pool, are laterally oscillated, and are optionally moved upward against the casting rolls. It is appreciated that vertical movement may assist in reducing the formation, severity, and frequency of skulls. In an exemplary embodiment configured to provide both lateral oscillations and vertical movement, FIG. 4 shows side dam 20, side dam holder 100, oscillation plate 210, fixed plate 220, vertical lift plate 230, and upper wedge 240, and lower wedge 250. Side dam 20 is supported by side dam holder 100. Oscillation plate 210 is operably connected to the side dam holder, and provides for the lateral oscillation of the side dam holders and adjacent side dams. Oscillations are generated by an oscillating mechanism comprising an eccentric connected to a rotational shaft driven by a motor. An eccentric may form an eccentric rotary shaft or a disc or wheel mounted eccentrically on a rotational shaft in order to transform rotation into backward-and-forward motion, such as by way of a cam. An eccentric may take any other form that transforms rotation into backward-and-forward motion. As for the motor, and motor may be employed, such as any electric motor or internal combustion engine. In other variations, the oscillating mechanism comprises a cylinder arranged to extend and retract in a lateral direction. Each side dam may be laterally oscillated between 2 and 50 hertz during a casting campaign, or may be laterally oscillated between 2 and 30 hertz during the casting campaign. Hydraulic cylinder 350, vertical lift plate 230, upper wedge 240 and lower wedge 250 provide for the optional vertical movement of the side dam holders and adjacent side dams during the casting campaign. Each side dam holder and adjacent side dam may be vertically moved at least 100 μm during the casting campaign. Alternatively, each side dam holder and adjacent side dam may be vertically moved between 3 and 15 millimeters during the casting campaign.

Figure 11:
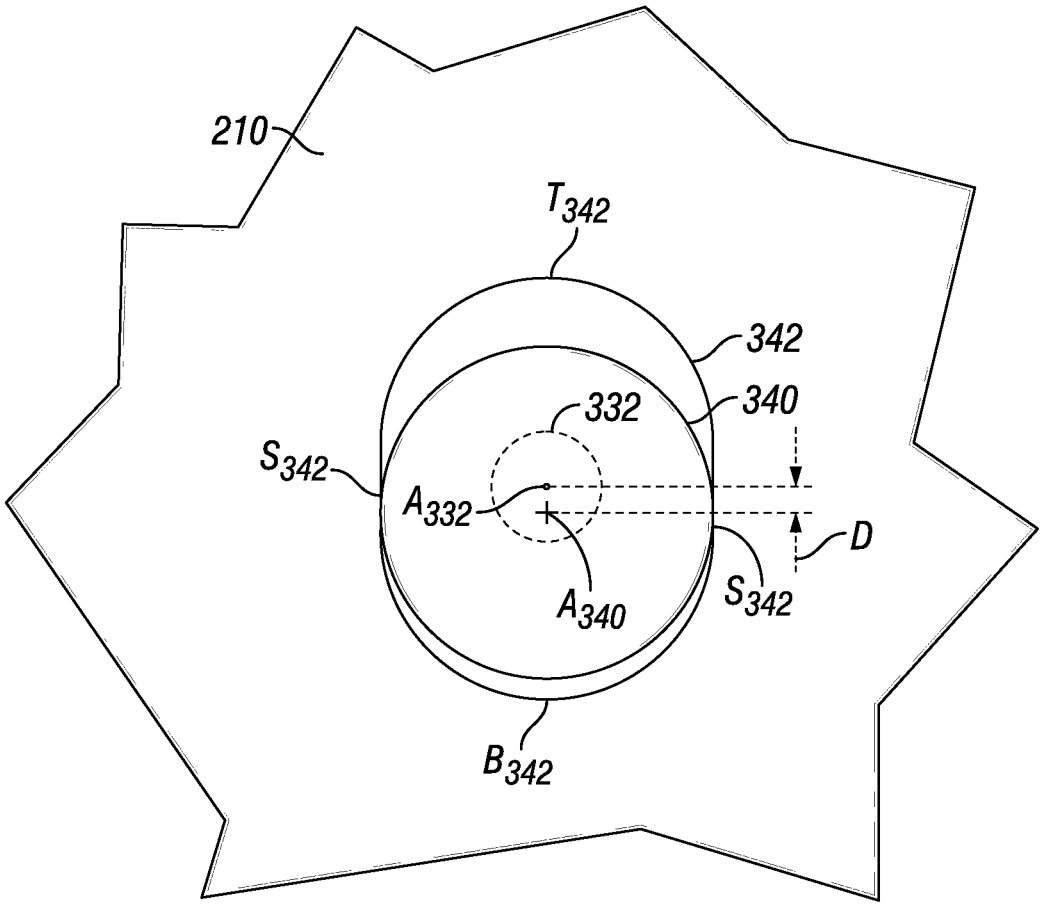
FIG. 11 illustrates an eccentric used to induce oscillations for the oscillating side dam in accordance with an exemplary embodiment of the present invention.

In the embodiment shown in FIG. 5, a portion of the caster is shown comprising a carriage that is configured to oscillate a side dam, which incorporates dovetailed attachment of the side dam to the side dam holder. In this exemplary embodiment, the side dam is not configured to move vertically. Therefore, oscillation of the side dam is limited to lateral oscillations. While this may be achieved using other oscillating mechanisms, in this embodiment, lateral-only oscillations are achieved by an oscillating mechanism comprising a motor 330 operating in cooperation with an eccentric. In this variation, the motor is a hydraulic motor operably connected to a rotational (drive) shaft 332. An encoder 334 is arranged along the length of the rotational shaft 332 to track the rotational position of the shaft. In an effort to control and limit the oscillatory movement of the side dam holder 100 and side dam 20 in a substantially lateral direction, a plurality of plain, linear bearings 336 slidably attach the oscillation plate to the carriage. A fixed attachment is provided between the oscillation plate 210 and the side dam holder 100, which are spaced apart in this embodiment to better protect the oscillation plate from heat exposure. Also, the oscillation plate 210 is water cooled by way of a water cooling system 338 to further control temperatures. With additional reference to FIG. 11, the eccentric comprises a cylindrical member 340 mounted non-axially on the rotational shaft 332. In other words, the central axis $A_{340}$ of the cylindrical member 340 is offset by distance D from the rotational axis $A_{332}$ of the rotational shaft 332. By doing so, the annular extent of the cylindrical member 340 induces lateral oscillations when engaging horizontal sides $S_{342}$ of an oblong opening 342 in the oscillation plate 210. In particular, the oblong opening 342 is narrowest between opposing horizontal sides $S_{342}$ and longest between top $T_{342}$ and bottom $B_{342}$. In operation, cylindrical member 340 engages horizontal sides $S_{342}$ to cause lateral oscillations while remaining spaced apart from each of the top $T_{342}$ and bottom $B_{342}$ to avoid any movement in the vertical direction and any vertical oscillations. It is appreciated that the oblong opening 342 may form a cutout in the oscillation plate 210 or may form an oblong opening in a bushing or other member attached to a larger opening formed in the oscillation plate 210. By using a motor with an eccentric, oscillating frequency may be adjusted, in addition to adjusting the stroke (amplitude) of the oscillations. Additionally, the generation of any desired oscillating frequency may be more reliably generated.

Figure 12:
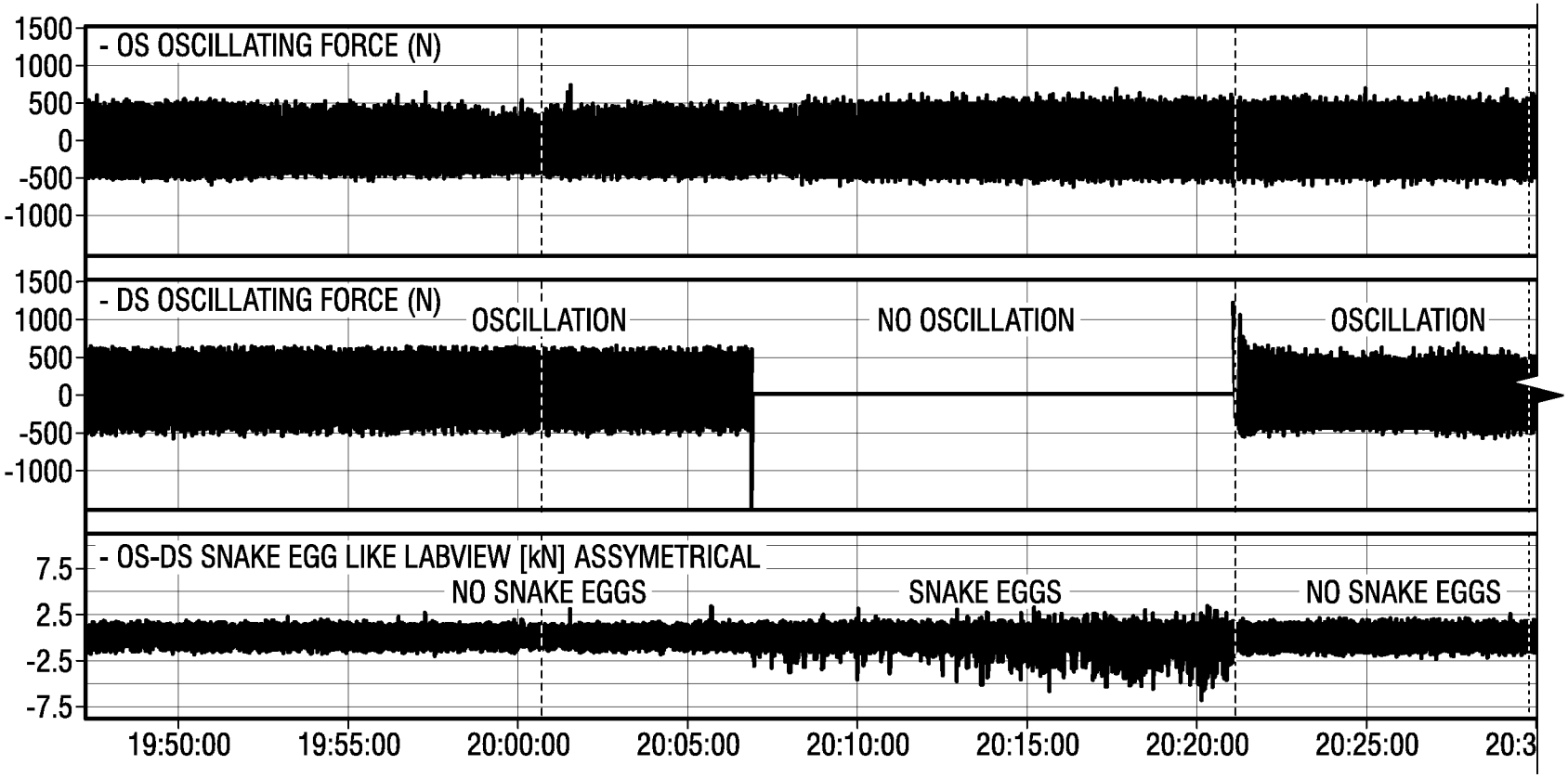
FIG. 12 illustrates a graph showing the impact on snake egg formation with oscillation of a side dam holder and adjacent side dam in accordance with the present invention; and, FIG. 13 illustrates a graph showing the impact on snake egg formation with oscillation of a side dam holder and adjacent side dam in accordance with the present invention.
Figure 13:
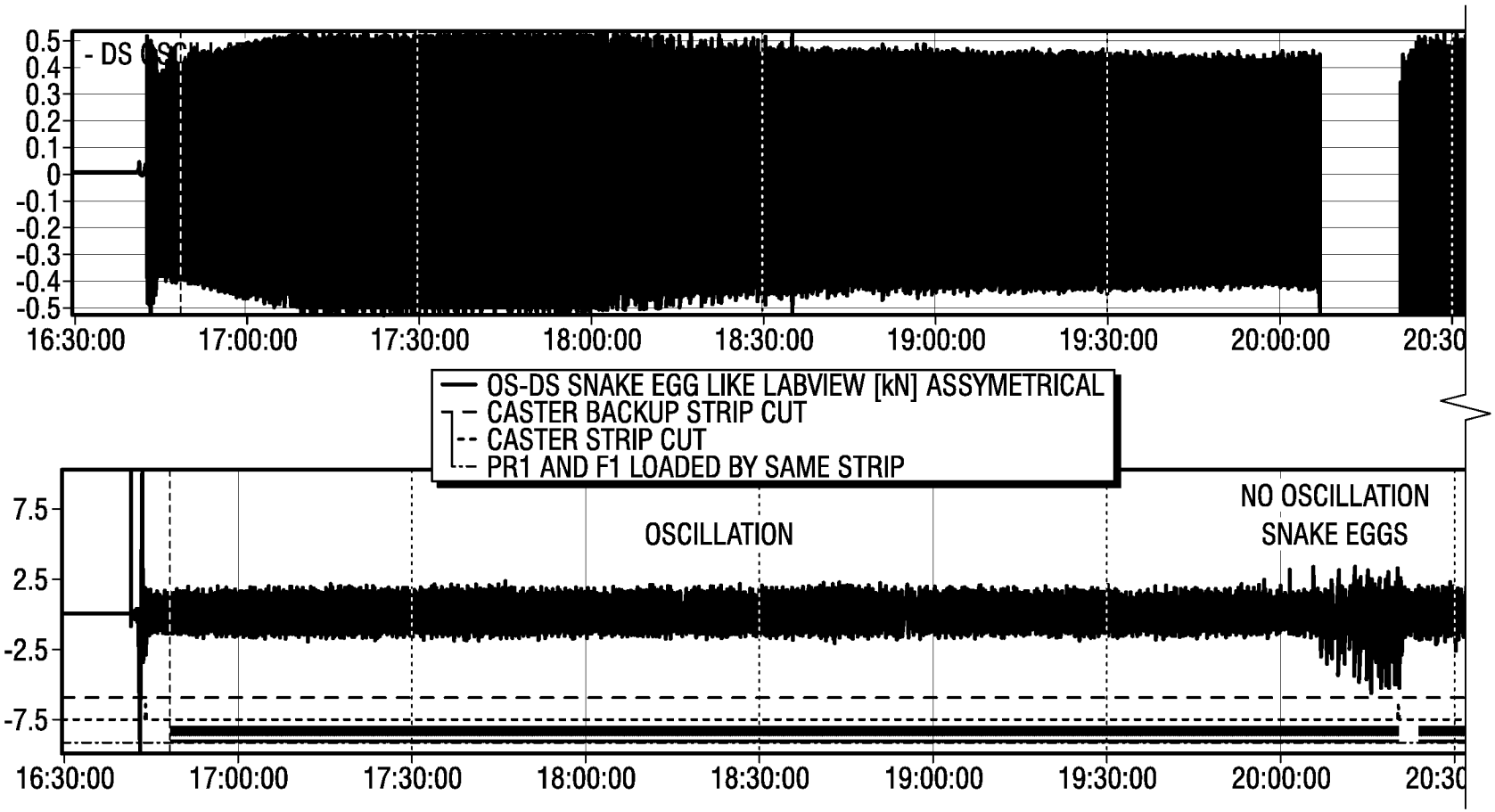

As illustrated in FIGS. 12 and 13, lateral oscillation of the side dam holder and adjacent side dam allows for substantial reduction or elimination of snake eggs in the strip. As shown in FIG. 12, no snake eggs were seen when the side dam holders and adjacent side dams were laterally oscillated in this embodiment. However, when lateral oscillation of the side dam holders and adjacent side dams was stopped, snake eggs were found to immediately be observed. And once the side dam holders and adjacent side dams were laterally oscillated again, snake eggs were once again immediately reduced, if not eliminated. As shown, lateral oscillation of the side dam holder and adjacent side dam allows for the prevention of snake eggs formation.

Similarly, in FIG. 13, the side dam holders and adjacent side dams were laterally oscillated. No snake eggs were observed during oscillation. Nonetheless, once the side dam holders and adjacent side dams were ceased to be oscillated, snake eggs were immediately observed. Lateral oscillation of the side dam holder and adjacent side dam allows for substantial reduction or prevention of snake eggs in the strip.

In further evaluating the impact of laterally oscillating the side dams, after observation a plurality of castings, in forming a single coil of cast strip, the occurrence of snake eggs reduced from 15.22 on average per coil using non-oscillating side dams to 5.57 on average per coil using laterally oscillating side dams. The severity of each snake egg was also reduced on average by 45%.

Additionally, by oscillating the side dam, the molten metal supplied to the caster may be reduced, which reduces manufacturing costs by eliminating the need to generate and supply additional heat to the molten steel. In certain instances, a reduction of 25 degrees F. has been successfully employed when producing cast strip using oscillating side dams, which is a 10 to 12% reduction in temperature relative to the liquidus temperature.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. An apparatus for continuous casting metal strip reducing snake eggs, said apparatus comprising:

a. a pair of counter rotating casting rolls arranged laterally to form a nip there between through which the strip is cast, each casting roll less than 800 millimeters in diameter;

b. a metal delivery system disposed above the nip and capable of discharging molten metal to form a casting pool supported on the casting rolls;

c. a pair of side dam holders and a pair of side dams assembled adjacent each end portion of the casting rolls, each side dam holder tapered along edge portions configured to dovetail with edge portions of an adjacent side dam assembled in position, and each side dam configured to confine the casting pool of molten metal supported on casting surfaces of the casting rolls above the nip; and d. an oscillation mechanism configured to apply lateral oscillation of each side dam and side dam holder together at a frequency between 2 and 50 hertz and with an amplitude between 100 μm and 2000 μm during a casting campaign.

2. The apparatus for continuous casting metal strip as claimed in claim 1 where the oscillation mechanism is configured to apply lateral oscillation of each side dam holder and adjacent side dam at a frequency between 2 and 30 hertz and with an amplitude between 100 μm and 2000 μm.

3. The apparatus for continuous casting metal strip as claimed in claim 1 where the oscillation mechanism is configured to apply lateral oscillation of each side dam holder and adjacent side dam at a frequency between 2 and 50 hertz and with an amplitude between 100 μm and 1250 μm.

4. The apparatus for continuous casting metal strip as claimed in claim 1 where the oscillation mechanism is configured to apply lateral oscillation of each side dam holder and adjacent side dam at a frequency between 2 and 30 hertz and with an amplitude between 100 μm and 1250 μm.

5. The apparatus for continuous casting metal strip as claimed claim 1, wherein the edge portions of each side dam holder tapered to dovetail with the adjacent side dam are tapered at between 3 and 15 degrees.

6. The apparatus for continuous casting metal strip as claimed claim 1 further comprising a mechanism providing vertical movement of each side dam holder and adjacent side dam of at least 100 μm per hour during the casting campaign.

7. The apparatus for continuous casting metal strip as claimed in claim 6 wherein the edge portions of each side dam holder tapered to dovetail with the adjacent side dam are tapered between 3 and 15 degrees.

8. The apparatus for continuous casting metal strip as claimed claim 1 further comprising a mechanism providing vertical movement of each side dam holder and adjacent side dam by between 3 and 15 millimeters during the casting campaign.

9. The apparatus for continuous casting metal strip as claimed in claim 8 where the edge portions of each side dam holder tapered to dovetail with the adjacent side dam are tapered between 3 and 15 degrees.

10. A method of continuously casting metal strip comprising the steps of:

(a) assembling a pair of counter-rotating casting rolls laterally forming a nip between circumferential casting surfaces of the casting rolls through which metal strip is cast;

(b) assembling a pair of side dam holders and a pair of side dams adjacent each end portion of the casting rolls with each side dam holder tapered along edge portions configured to dovetail with edge portions of an adjacent side dam assembled in position, and with each side dam configured to confine a casting pool of molten metal supported on casting surfaces of the casting rolls above the nip;

(c) assembling a metal delivery system above the casting rolls delivering molten metal to form a casting pool supported on the casting surfaces of the casting rolls above the nip and confined by the side dams at each end portion of the casting rolls;

(d) laterally oscillating each side dam holder and adjacent side dam at a frequency between 2 and 50 hertz with an amplitude between 100 μm and 2000 μm during a casting campaign; and (e) counter-rotating the casting rolls such that the casting surfaces of the casting rolls each travel inwardly toward the nip to produce a cast strip downwardly from the nip.

11. The method of continuously casting metal strip as claimed in claim 10 further comprising laterally oscillating each side dam holder and adjacent side dam at a frequency between 2 and 30 hertz with an amplitude between 100 μm and 2000 μm during a casting campaign.

12. The method of continuously casting metal strip as claimed in claim 10 further comprising laterally oscillating each side dam holder and adjacent side dam at a frequency between 2 and 50 hertz with an amplitude between 100 μm and 1250 μm during a casting campaign.

13. The method of continuously casting metal strip as claimed in claim 10 further comprising laterally oscillating each side dam holder and adjacent side dam at a frequency between 2 and 30 hertz with an amplitude between 100 μm and 1250 μm during a casting campaign.

14. The method of continuously casting metal strip as claimed in claim 10 wherein the edge portions of each side dam holder tapered to dovetail with the adjacent side dam are tapered between 3 and 15 degrees.

15. The method of continuously casting metal strip as claimed in claim 10 further comprising vertically moving each side dam holder and adjacent side dam at least 100 μm per hour during a casting campaign.

16. The method of continuously casting metal strip as claimed in claim 15 wherein the edge portions of each side dam holder tapered to dovetail with the adjacent side dam are tapered between 3 and 15 degrees.

17. The method of continuously casting metal strip as claimed in claim 10 further comprising vertically moving each side dam holder and adjacent side dam between 3 and 15 millimeters during a casting campaign.

18. The method of continuously casting metal strip as claimed in claim 17 wherein the edge portions of each side dam holder tapered to dovetail with the adjacent side dam are tapered between 3 and 15 degrees.

19. The method of continuously casting metal strip as claimed in claim 10, where triple point pouring of molten metal is discontinued during part of the casting campaign.

20. The method of continuously casting metal strip as claimed in claim 10, where in assembling the pair of side dam holders and the pair of side dams adjacent each end portion of the casting rolls, the side dam is assembled at an ambient temperature.

21. The method of continuously casting metal strip as claimed in claim 10, where the molten metal delivered by the metal delivery system is delivered at a reduced temperature.

22. A side dam assembly for continuously casting metal strip, said side dam assembly comprising a side dam holder with edge portions configured to dovetail with and support an adjacent side dam by tapering between 3 and 15 degrees to hold the adjacent side dam and configured to oscillate with the side dam holder laterally in a direction extending across a nip formed between a laterally arranged pair of counter rotating casting rolls.

23. A side dam assembly for continuous casting metal strip, said side dam assembly comprising:

(a) a pair of side dams adjacent to end portions of a pair of counter-rotating casting rolls arranged laterally, each casting roll with less than 800 millimeters in diameter and positioned to form a nip there between through which thin strip is cast, with each side dam configured to confine a casting pool of molten metal supported on casting surfaces of the casting rolls above the nip;

(b) a pair of side dam holders, each side dam holder supporting an adjacent side dam and tapered along edge portions configured to dovetail with edge portions of the adjacent side dam assembled in position and configured to move with the adjacent side dam; and (c) an oscillation mechanism configured to apply lateral oscillation of each side dam and side dam holder together at a frequency between 2 and 50 hertz and with an amplitude between 100 μm and 2000 μm during a casting campaign.

24. The side dam assembly for continuous casting metal strip as claimed in claim 23, wherein the oscillation mechanism is configured to apply lateral oscillation of each side dam and side dam holder together at a frequency between 2 and 30 hertz and with an amplitude between 100 μm and 2000 μm during a casting campaign.

25. The side dam assembly for continuous casting metal strip as claimed in claim 23, wherein the oscillation mechanism is configured to apply lateral oscillation of each side dam and side dam holder together at a frequency between 2 and 30 hertz and with an amplitude between 100 μm and 1250 μm during a casting campaign.

26. The side dam assembly for continuous casting metal strip as claimed in claim 23, wherein the oscillation mechanism is configured to apply lateral oscillation of each side dam and side dam holder together at a frequency between 2 and 50 hertz and with an amplitude between 100 μm and 1250 μm during a casting campaign.

27. The side dam assembly for continuous casting metal strip as claimed in claim 23, wherein the edge portions of each side dam holder tapered to dovetail with the adjacent side dam are tapered at between 3 and 15 degrees.

28. The side dam assembly for continuous casting metal strip as claimed in claim 23 further comprising a mechanism providing vertical movement of each side dam holder and adjacent side dam of at least 100 μm per hour during the casting campaign.

29. The side dam assembly for continuous casting metal strip as claimed in claim 28, wherein the edge portions of each side dam holder tapered to dovetail with the adjacent side dam are tapered at between 3 and 15 degrees.

30. The side dam assembly for continuous casting metal strip as claimed in claim 23 further comprising a mechanism providing vertical movement of each side dam holder and adjacent side dam by between 3 and 15 millimeters during the casting campaign.

31. The side dam assembly for continuous casting metal strip as claimed in claim 30, wherein the edge portions of each side dam holder tapered to dovetail with the adjacent side dam are tapered at between 3 and 15 degrees.

* * * * *